US005200734A

United States Patent [19]

Lin

[11] Patent Number: 5,200,734

[45] Date of Patent: Apr. 6, 1993

[54] DETECTING AND ALARMING SYSTEM FOR DETECTING SHORTCIRCUITED OR BROKEN CIRCUIT

[76] Inventor: Tieng-Fu Lin, c/o Hung Hsing Patent Service Center, P.O. Box 55-1670, Taipei (10477), Taiwan

[21] Appl. No.: 817,321

[22] Filed: Jan. 6, 1992

[51] Int. Cl.[5] ..... G08B 29/00

[52] U.S. Cl. ..... 340/508; 340/509

[58] Field of Search ..... 340/508-513, 340/506, 541, 545, 547

[56] References Cited

U.S. PATENT DOCUMENTS 3,474,299 10/1969 Caputo ..... 340/511

3,653,041 3/1972 McGrath et al. ..... 340/508

3,678,509 7/1972 Carlo et al. ..... 340/511

4,435,700 3/1984 Alley ..... 340/508

*Primary Examiner*—Donnie L. Crosland

[57] ABSTRACT

A detecting and alarming system includes a main alarm circuit provided in a headquarter control center, at least a terminal alarm circuit provided at a local station, and at least a connecting loop conecting the main alarm circuit and each terminal alarm circuit, whereby upon a cutting or a shortcircuiting of the connecting loop between the headquarter control center and the local station, an alarm will be actuated for warning the breaking or shortcircuiting situation.

5 Claims, 1 Drawing Sheet

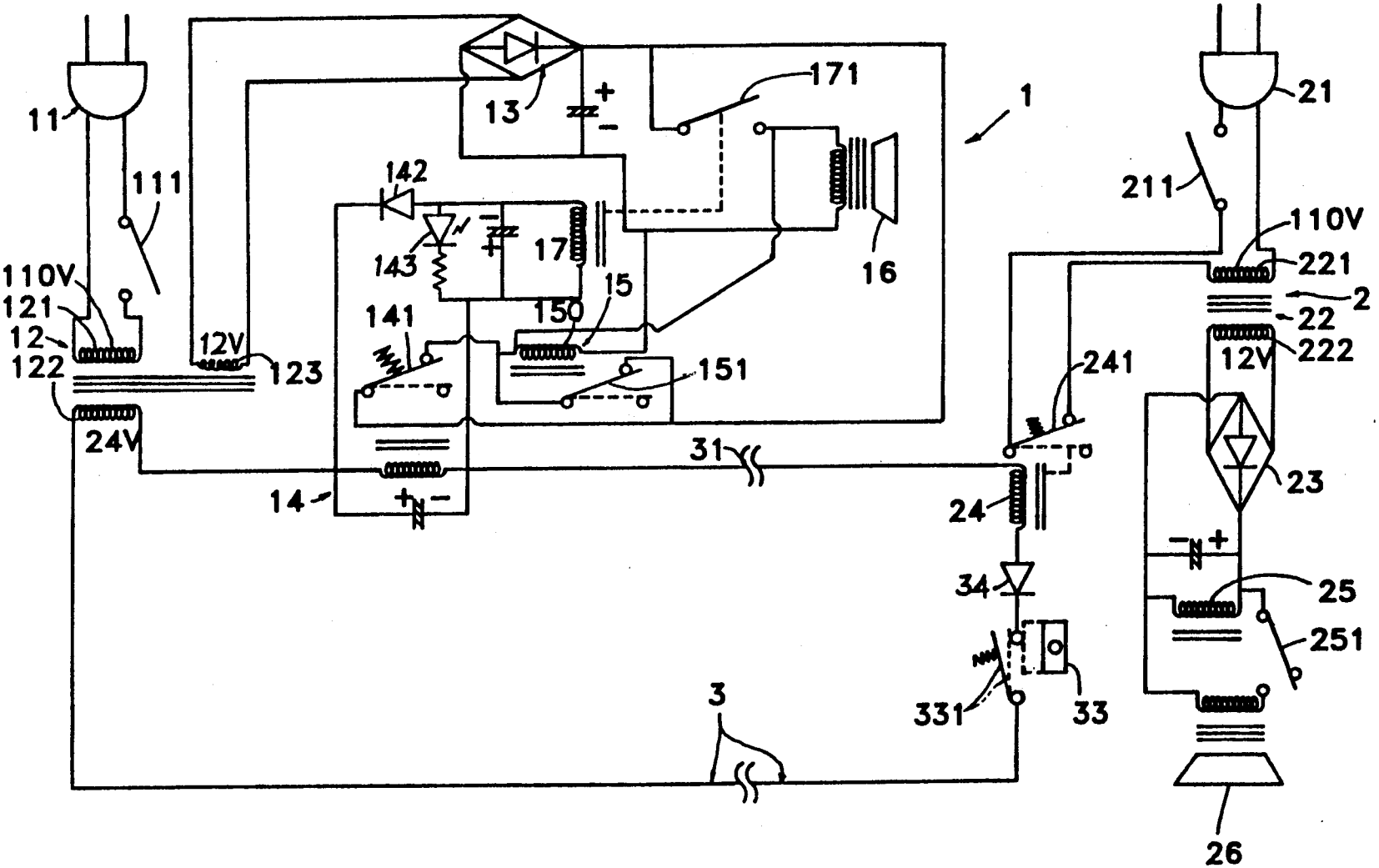
21
110V
221
2
22
222
12V
23
25
251
26
211
241
33
1
24
34
331
16
171
31
3
151
15
150
13
17
142
143
141
14
123
12V
111
24V
11
110V
121
12
122

DETECTING AND ALARMING SYSTEM FOR DETECTING SHORTCIRCUITED OR BROKEN CIRCUIT

BACKGROUND OF THE INVENTION

A conventional alarm circuit such as connected between a security company and a client may be cut once intruded by a thief or robber, thereby losing its alarming effect or chance for asking help.

It is therefore expected to disclose a detecting and alarming system capable of producing alarm signal once the alarming circuit has been broken or shortcircuited for security purpose.

SUMMARY OF THE INVENTION

The object of the present invention is to provide a detecting and alarming system including a main alarm circuit provided in a headquarter control center, at least a terminal alarm circuit provided at a local station, and at least a connecting loop connecting the main alarm circuit and each terminal alarm circuit, whereby upon a cutting or a shortcircuiting of the connecting loop between the headquarter control center and the local station, an alarm will be actuated for warning the breaking or shortcircuiting situation.

BRIEF DESCRIPTION OF THE DRAWING

The single drawing FIGURE shows a circuit of the detecting and alarming system in accordance with the present invention.

DETAILED DESCRIPTION

As shown in the single drawing FIGURE, the present invention comprises: a main alarm circuit 1, at least a terminal alarm circuit 2, and at least a connecting loop 3 connecting the main alarm circuit 1 and each terminal alarm circuit 2. The main alarm circuit 1 may be provided in a headquarter control center of a security company or a control room of a multi-story building, a plant or a management head office; whereas the terminal alarm circuit 2 may be provided at a local station of a client's room monitored by a security company or a floor control desk (or counter) of a multi-story building. A plurality of terminal alarm circuits 2 may be connected in parallel with the main alarm circuit 1 through each connecting loop 3.

The main alarm circuit 1 includes: a main power source of alternative current 11 having a main power switch 111 for an on-off control of the power source, a first transformer 12 respectively converting a high input voltage such as of 11 volts to a first lower output voltage such as of 24 volts (122) for powering the connecting loop 3 and converting the high input voltage to a second lower voltage such as 12 volts (123) for powering a main alarm 16, a first rectifier 13 converting an input alternative current to be a direct current for powering the main alarm 16, a choke 14, which is connected between a positive pole and a negative pole of the connecting loop 3 and powered for normally electromagnetically attracting a first contactor switch 141, which normally closes the main alarm circuit as connected across two poles of the first rectifier 13, for disconnecting the main alarm circuit 1, an automatic holding circuit 15 including an electromagnetic coil 150 and a second contactor switch 151 connected in series across two output poles of the first rectifier 13 with the electromagnetic coil 150 further connected in series with the first contactor switch 141, and a first relay 17 connected in parallel with the choke 14 through a diode 142 and operatively closing a relay switch 171 connected between a rectified power source through the first rectifier 13 and the main alarm 16 for actuating the main alarm 16 electrically connected across the two output poles of the first rectifier 13, whereby upon a breaking of the connecting loop 3 as shown at numeral 31 of the FIGURE, the choke 14 will not be powered by the connecting loop 3 and the first contactor switch 141 will be restored and closed to close the main alarm circuit 1 for sounding the main alarm 16 which may be a buzzer as shown in the FIGURE; and whereby upon a shortcircuiting of the connecting loop 3, an alternative-current (AC) signal will be produced across the choke 14 and the AC signal is rectified by the diode 142 connected between the relay 17 and the choke 14 to actuate the relay 17 to close the relay switch 171 for sounding the alarm 16.

Since the first contactor switch 141 is originally closed (on) to close the main alarm circuit 1 when the connecting loop 3 is not powered, and in the situation when the loop 3 is cut by a thief or an intruder to disconnect the power supply, the alarm 16 will be sounding for security detecting purpose.

However, when a municipal utility power failure is accidentally caused, the loop 3 is also not powered to thereby sound the alarm 16. Nevertheless, it is beneficial for the present invention, since it renders an opportunity for checking the alarm circuit whether at condition of good performance ready for use or not.

Each terminal alarm circuit 2 includes: a terminal power source of alterative current 21, which may be supplied by a municipal power supply source as same as that for the main alarm circuit 1, having a terminal power switch 211 for on/off control of the power source 21, a second transformer 22 having primary windings 221 and secondary windings 222 for converting a high input voltage of 110 volts to a low output voltage of 12 volts (222), which is then rectified by a second rectifier 23 to be a direct current for powering a terminal alarm 26, a second relay 24 including an electromagnetic coil connected across two poles of the connecting loop 3 operatively attracting a terminal contactor switch 241, which is normally closed for closing two poles across the primary windings 221 of the terminal power source 21, for opening the terminal contactor switch 241 when the second relay 24 is actuated and powered by the connecting loop 3, and a third relay 25 connected across two output poles of the second rectifier 23 and operatively closing a relay switch 251 connected between the second rectifier 23 and the terminal alarm 26 for actuating the terminal alarm 26 electrically connected between the two poles of the second rectifier 23, whereby upon a breaking of the connecting loop 3, the terminal contactor switch 241 will be restored to close the primary windings 221 for powering the third relay 25 with a direct current transformed by the second transformer 22 and rectified by the second rectifier 23 for closing the relay switch 251 for actuating the terminal alarm 26 for sounding an alarm if made as a buzzer as shown in the FIGURE.

The connecting loop 3 includes: a set of secondary windings 122 for directing an input transformed low voltage current from the first transformer 12 for powering the loop 3 normally, a diode 34 and a sensor contactor switch 331 normally closed and connected in series with the diode 34 connected across two poles of the connecting loop, and a sensor 33 provided in a proximity to the loop 3 in cooperation with the sensor contactor switch 331 for operatively sensing an intruder for switching off the sensor contactor switch 331 for disconnecting the loop 3 for actuating the alarms 16, 26.

The sensor 33 may be a magnet mounted on a door and the sensor contactor switch 331 may be a reed switch mounted on a door frame, with the reed switch being normally closed as attracted by the magnet when closing the door for approximating the magnet to the reed switch, whereby upon an opening of the door such as opened by an intruder to separate the magnet from the reed switch, the reed switch will be opened for actuating the alarms 16, 26.

The present invention is provided with the automatic holding circuit 15 for ensuring an affirmative detecting job, whereby once upon an opening of the door by an intruder who immediately closes the door trying to deactivate the alarm sounding, the first opening of the door will disconnect the power of the loop 3 to close the contactor switch 141 and close the circuit of the coil 150 which will electromagnetically attract the second contactor switch 151 for powering and sounding the alarm 16.

As shown in the FIGURE, a positive pole of the rectified power supply of the main alarm circuit 1 is connected, through switch 141 of choke 14, and the coil 150, to the negative pole and the positive pole is also connected through the contactor switch 151 in parallel with the contactor switch 141, an input pole of the coil 150, two poles of the alarm 16 and then to the negative pole of the rectified power supply, therefore ensuring automatic circuit holding effect by the automatic holding circuit of the present invention.

For stopping alarm sounding, either switch 111 or 211 may be switched off to disconnect the power supply to the system until any intrusion problem is overcome and then the switches 111, 211 must be reset to be ready for detecting service.

Several capacitors are provided in this invention each capacitor connected in parallel with a coil for stabilizing voltage and for filtering off any interference waves in the circuits.

The present invention may also be used for detecting a breaking wire within a plurality of wires used for maintenance work for checking a breaking condition for electrical wires.

The present invention provides a detecting and alarming system which may be used for security purpose, such that if a thief breaks the loop 3 trying to disconnect the alarm system circuit or even shortcircuits the alarm circuit, the alarm either at headquarter control center (such as a security company) or local station (such as a client's home) will be operatively actuated for giving warning to the relevant personnels for preventing being stolen.

The present invention may be modified to have optical alarm devices, such as a light emitting diode 143 connected across the two poles of the relay 17 for an illuminative warning such as in case of a shortcircuiting of the loop 3 by an intruder.

I claim:

1. A detecting and alarming system comprising:

a main alarm circuit provided in a headquarter control center including a main alarm powered by a main power source;

at least a terminal alarm circuit having a terminal alarm powered by a terminal power source; and at least a connecting loop connected between said main alarm circuit and each said terminal alarm circuit and powered by said main alarm circuit having means for actuating either said main alarm circuit and said terminal alarm circuit upon a breaking or a shortcircuiting in the connecting loop, whereby upon a breaking of each said connecting loop, said main alarm and one said terminal alarm will be actuated for giving a warning in response to the breaking of the loop; and upon a shortcircuited of the loop, said main alarm will be actuated for giving a warning in response to the shortcircuiting of said loop;

said main alarm circuit 1 including: the main power source of alternative current 11 having a main power switch 111 for an on-off control of the main power source, a first transformer 12 respectively converting a high input voltage to a first lower output voltage (122) for powering the connecting loop 3 and converting the high input voltage to a second lower voltage (123) for powering the main alarm 16, a first rectifier 13 converting an input alternative current to be a direct current for powering the main alarm 16, a choke 14, which is connected between a positive pole and a negative pole of the connecting loop 3 and powered for normally electromagnetically attracting a first contactor switch 141, which normally closes the main alarm circuit as connected across two poles of the first rectifier 13, and for disconnecting the main alarm circuit 1, an automatic holding circuit 15 including an electromagnetic coil 150 and a second contactor switch 151 connected in series across two output poles of the first rectifier 13 with the electromagnetic coil 150 further connected in series with the first contactor switch 141, and a first relay 17 connected in parallel with the choke 14 through a diode 142 and operatively closing a relay switch 171 connected between a rectified power source through the first rectifier 13 and the main alarm 16 for actuating the main alarm 16 electrically connected across the two poles of the first rectifier 13, whereby upon a breaking of the connecting loop 3, the choke 14 will not be powered by the connecting loop 3 and the first contactor switch 141 will be restored to close the main alarm circuit 1 for sounding the main alarm 16; and whereby upon a shortcircuiting of the connecting loop 3, an alternative-current (AC) signal will be produced across the choke 14 and the AC signal is rectified by the diode 142 connected between the first relay 17 and the choke 14 to actuate the relay 17 to close the relay switch 171 for sounding the alarm 16.

2. A detecting and alarming system according to claim 1, wherein each said terminal alarm circuit 2 includes: the terminal power source of alterative current 21, having a terminal power switch 211 for controlling the terminal power source, a second transformer 22 having primary windings 221 and secondary windings 222 for converting a high input voltage to a low output voltage (222), which is then rectified by a second rectifier 23 to be a direct current for powering the terminal alarm 26, a second relay 24 including an electromagnetic coil connected across two poles of the connecting loop 3 operatively attracting a terminal contactor switch 241, which is normally closed for closing two poles across the primary windings 221 of the terminal power source 21, for opening the terminal contactor switch 241 when the second relay 24 is actuated and powered by the connecting loop 3, and a third relay 25 connected across two output poles of the second rectifier 23 and operatively closing a relay switch 251 connected between the second rectifier 23 and the terminal alarm 26 for actuating the terminal alarm 26 electrically connected between the two poles of the second rectifier 23, whereby upon a breaking of the connecting loop 3, the terminal contactor switch 241 will be restored to close the primary windings 221 for powering the third relay 25 with a direct current transformed by the second transformer 22 and rectified by the second rectifier 23 for closing the relay switch 251 for actuating the terminal alarm 26.

3. A detecting and alarming system according to claim 1, wherein each said connecting loop 3 includes: a set of secondary windings 122 for directing an input transformed low voltage current from the first transformer 12 fo powering the loop 3 normally, and a diode 34 connected in said loop and a sensor contactor switch 331 normally closed and connected in series with the diodes 34 connected across two poles of the connecting loop 3, and a sensor 33 provided in a proximity of the loop 3 in cooperation with the sensor contactor switch 331 for operatively sensing an intruder for switching off the sensor contactor switch 331 for disconnecting the loop 3 for actuating the main and terminal alarms 16, 26.

4. A detecting and alarming system according to claim 3, wherein said sensor 33 is a magnet mounted on a door and the sensor contactor switch 331 is a reed switch mounted on a door frame, with the reed switch being normally closed as attracted by the magnet when closing the door for approximating the magnet to the reed switch, whereby upon an opening of the door such as opened by an intruder to separate the magnet from the reed switch, the reed switch will be opened for actuating the main and terminal alarms 16, 26.

5. A detecting and alarming system according to claim 1, wherein said main alarm circuit includes: a positive pole of a rectified power supply of the main alarm circuit 1 across the first rectifier 13 being connected, through said first contactor switch 141 of said choke 14, and the coil 150 of said automatic holding circuit 15, to a negative pole of the rectified power supply, and the positive pole of the rectified power supply across the first rectifier is further connected through the second contactor switch 151 in parallel with the first contactor switch 141, an input pole of the coil 150, two poles of the main alarm 16 and then to the negative pole of the rectified power supply for completing the automatic holding circuit of said main alarm circuit.

* * * * *